US005103991A

United States Patent [19]

Collins

[11] Patent Number: 5,103,991

[45] Date of Patent: Apr. 14, 1992

[54] SCREW CLOSURES FOR CONTAINERS

[75] Inventor: Malcolm G. Collins, Wantage, United Kingdom

[73] Assignee: CMB Foodcan PLC, Worcester, United Kingdom

[21] Appl. No.: 665,979

[22] Filed: Mar. 7, 1991

[30] Foreign Application Priority Data

Mar. 10, 1990 [GB] United Kingdom ..... 9005417

[51] Int. Cl.[5] ..... B65D 41/04

[52] U.S. Cl. ..... 215/329; 215/252; 215/276; 215/331

[58] Field of Search ..... 215/252, 253, 218, 219, 215/350, 331, 329, 276

[56] References Cited

U.S. PATENT DOCUMENTS

| | | | |
|---|---|---|---|
| 2,009,666 | 7/1935 | Keith | 215/350 X |
| 3,603,472 | 9/1971 | Lecinski, Jr. et al. | 215/253 |
| 3,857,507 | 12/1974 | Lecinski, Jr. | 215/218 |
| 4,694,970 | 9/1987 | Hayes | 215/252 |
| 4,813,561 | 3/1989 | Ochs | 215/252 |
| 4,981,230 | 1/1991 | Marshall et al. | 215/252 |

FOREIGN PATENT DOCUMENTS

| | | |
|---|---|---|
| 0280024 | 8/1988 | European Pat. Off. . |
| 3833945 | 9/1989 | Fed. Rep. of Germany . |
| 2291915 | 6/1976 | France . |
| 727529 | 4/1955 | United Kingdom . |

*Primary Examiner*—Stephen P. Garbe
*Assistant Examiner*—Paul A. Schwarz
*Attorney, Agent, or Firm*—St.Onge Steward Johnston & Reens

[57] ABSTRACT

A screw closure for a container has a metal body shell (30) into which a plastics moulding (44) is snap-engaged. The moulding provides a screw thread (52) for the closure; in addition, it extends below the body shell to provide a security ring (50) which is attached by rupturable bridges (62). Relative rotation of the moulding and body shell when the closure is being fitted onto a container is prevented by teeth (58) formed around the top edge of the moulding, which deeply indents the sealing gasket (38) of the body shell.

14 Claims, 8 Drawing Sheets

VIII
IX
X
B
B
58
60
91
92
93
94
52A
62
82
83
84

SCREW CLOSURES FOR CONTAINERS

This invention relates to screw closures for containers, having closure panels arranged to overlie and seal around the container mouth, and depending tubular skirts arranged to provide a screw thread formation for engagement with a complementary screw thread formation on the container to hold the closure in sealing position. The invention is particularly concerned with screw closures of the kind which have a generally cylindrical thread-forming region in which the screw thread formation is or can be formed. This is to be contrasted with those metal closures—commonly and hereinafter referred to as "lug caps"—which have a screw thread formation in the form of spaced and inwardly projecting lugs formed in generally coplanar relation around the free edge of their tubular skirt.

Screw closures having generally cylindrical thread-forming regions are well known, formed essentially of either metal or plastics material. Among the metal screw closures are thin-walled aluminium closures, usually referred to as "Roll-on" or "RO" closures, for which a screw thread is formed by a rolling operation when the closure is in position on the container to be closed. A further, essentially metal, screw closure in which the thread formation is created in situ on the container is the well known "Press-Twist" or "PT" cap. In that closure the skirt is internally lined with a puffed plastisol lining compound which is capable of taking a cold set conforming it to threads on the container after the closure has been applied. Both of these closures are first applied to the container by simple axial motion, but the consumer has to rotate them in the appropriate direction for subsequent removal or replacment.

Plastics closures are commonly provided with cylindrical thread-forming regions in which a thread formation is moulded. Such closures are usually unitary, although they may have a sealing gasket separately provided or formed against the underside of their closure panel. Both they and the roll-on closures described above are commercially available with integral security or tamperevident rings designed to be engaged beneath a peripheral bead formation on the container.

In addition to metal and plastics screw closures, also known are composite screw closures having a metal closure disc or cup arranged for sealing engagement around the container mouth, and an outer shell of plastics material within which the disc or cup is received and which extends beyond the free edge of the disc or cup as a tubular skirt on which a screw thread for the container is formed. Again, it has been proposed to provide this kind of closure with a security ring, which is formed as an integral extension of the outer shell.

Whilst in no way limited in application to the packaging of such products, the present invention is of particular value for the packaging of food products which are either hot-filled or subjected to sterilisation or pasteurisation after filling and closing. For such products, especially those which are packed in wide-mouthed jars rather than narrow-mouthed bottles, metal closures have hitherto achieved substantially complete market acceptance in comparison with closures which either are made of plastics material or are viewed by the consumer as being essentially of plastics material. In this relation it is believed that metal closures are seen to have advantage over plastics closures in respect of print quality and robustness in particular.

Products of the kind recited in the previous paragraph, however, include baby and other foods which have been shown to be particularly susceptible to tampering. The metal closures which are most commonly used for such products are lug caps and PT caps, closures for which the arrangement and method of manufacture make it difficult or impossible to provide them with an integral (metal) security ring for providing or increasing their tamperindicating capability.

In their UK Patent Specification No. 727529 Applicants have disclosed a composite closure for a container, which has a metal body shell and an internal liner of thermoplastics material which provides a screw thread for attaching the closure to the container in the normal manner. Relative rotation of the liner and the body shell while the closure is being applied or removed is prevented by an adhesive bond which is formed between those items, possibly augmented by clamping engagement of the liner by the body shell as is illustrated in FIG. 5. However, the method of manufacturing proposed involves forming the plastics liner in situ within the body shell, and this makes it difficult or impossible to form the closure with a security ring for tamperindication.

The present invention seeks to provide a screw closure which, whilst being of composite construction, has the commercial advantages currently seen for metal closures and which furthermore, unlike the closure described in specification 727529, can be readily modified to provide it with a security ring for tamperindication. Accordingly, the present invention provides a screw closure for a container, having a metal body shell with a closure panel and a tubular skirt depending integrally therefrom, and a preformed tubular member of a moulded plastics material, the plastics member being fitted into the skirt of the body shell after moulding and providing within the skirt a generally cylindrical thread-forming region for engagement with a thread formation of the container.

The thread-forming region of the plastics member may be formed with a thread formation by the moulding process, or it may be adapted to conform to the thread formation on the container after the closure has been applied.

According to a first preferred feature of the invention the plastics member is extended beyond the free edge of the body shell as a security ring which is adapted, by engagement with the container, to provide evidence that the closure has been unscrewed from the container. The security ring may be attached by frangible bridges at which it may become detached from the remainder of the plastics member by axial and/or circumferential forces generated when the closure is unscrewed. It may engage the container by a plurality of circumferentially disposed ramp formations having generally radially directed abutment faces for cooperation with the abutment faces of complementary ramp formations on the container. As an alternative, however, the engagement of the security ring with the container may occur at a generally axially presented annular shoulder in cooperation with a complementary shoulder on the container.

According to a second preferred feature of the invention, which may be used in conjunction with the preferred feature recited above, the plastics member is snap-engaged into the body shell by generally axial movement in relation to the same. Such snap-engagement may advantageously occur by engagement of an inturned curl formed at the free edge of the body shell in a peripheral groove formed around the plastics member.

The plastics member may be arranged to engage a sealing gasket which is provided on the closure panel for sealing engagement with the container, so as to prevent relative rotation of the body shell and the plastics member when the closure is being fitted to or removed from the container. The sealing gasket is preferably formed in situ from a plastisol compound, although a preformed gasket is possible.

The invention will be more fully understood from the following description of three screw closures embodying the invention, now to be described by way of example only and with reference to the accompanying drawings. In the drawings.

Figure 4:
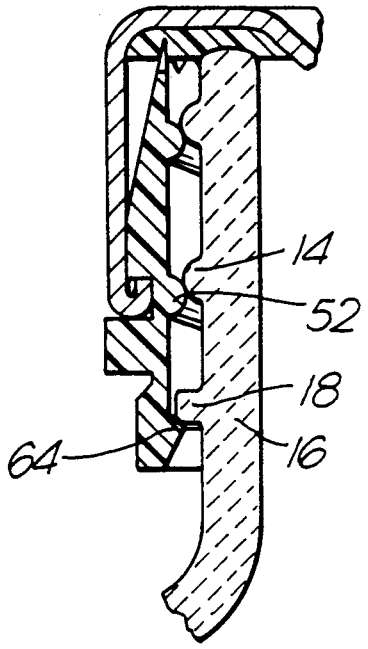
Figure 3:
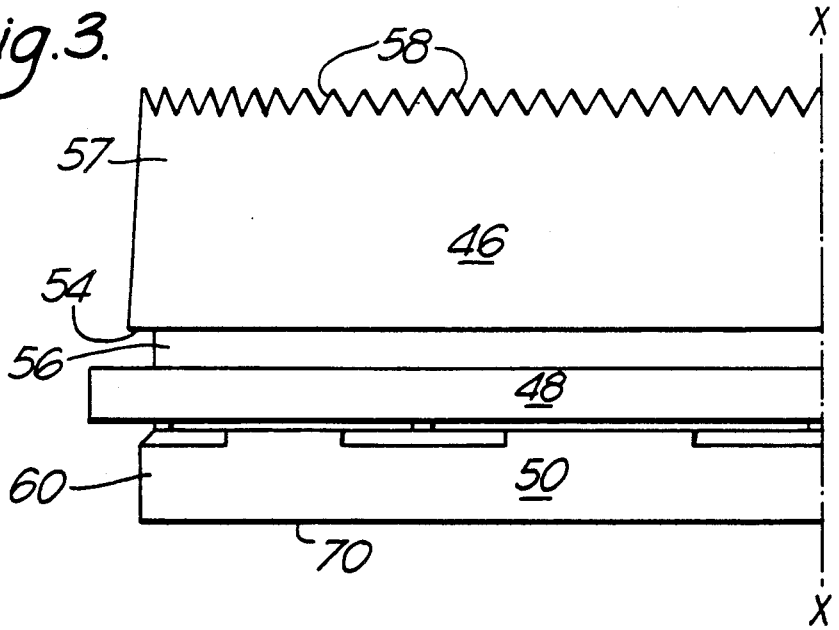
Figure 6:
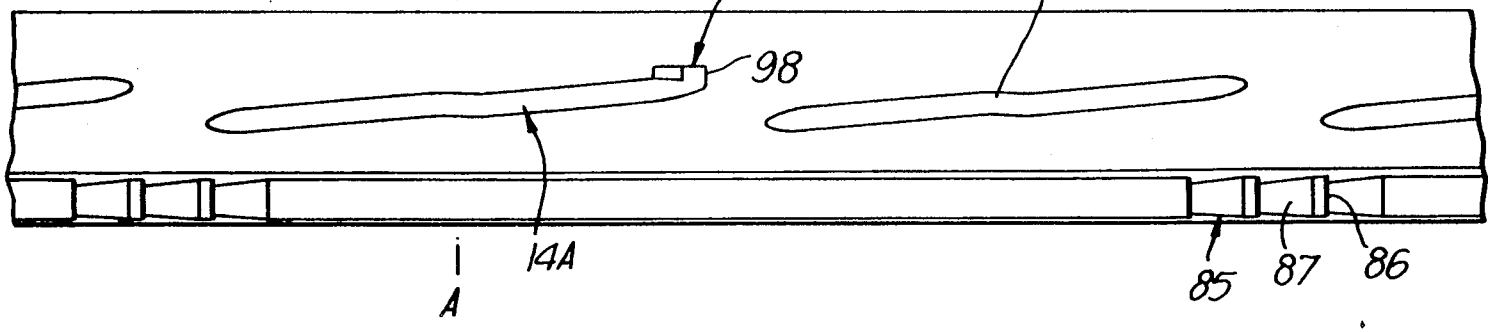
Figure 5:
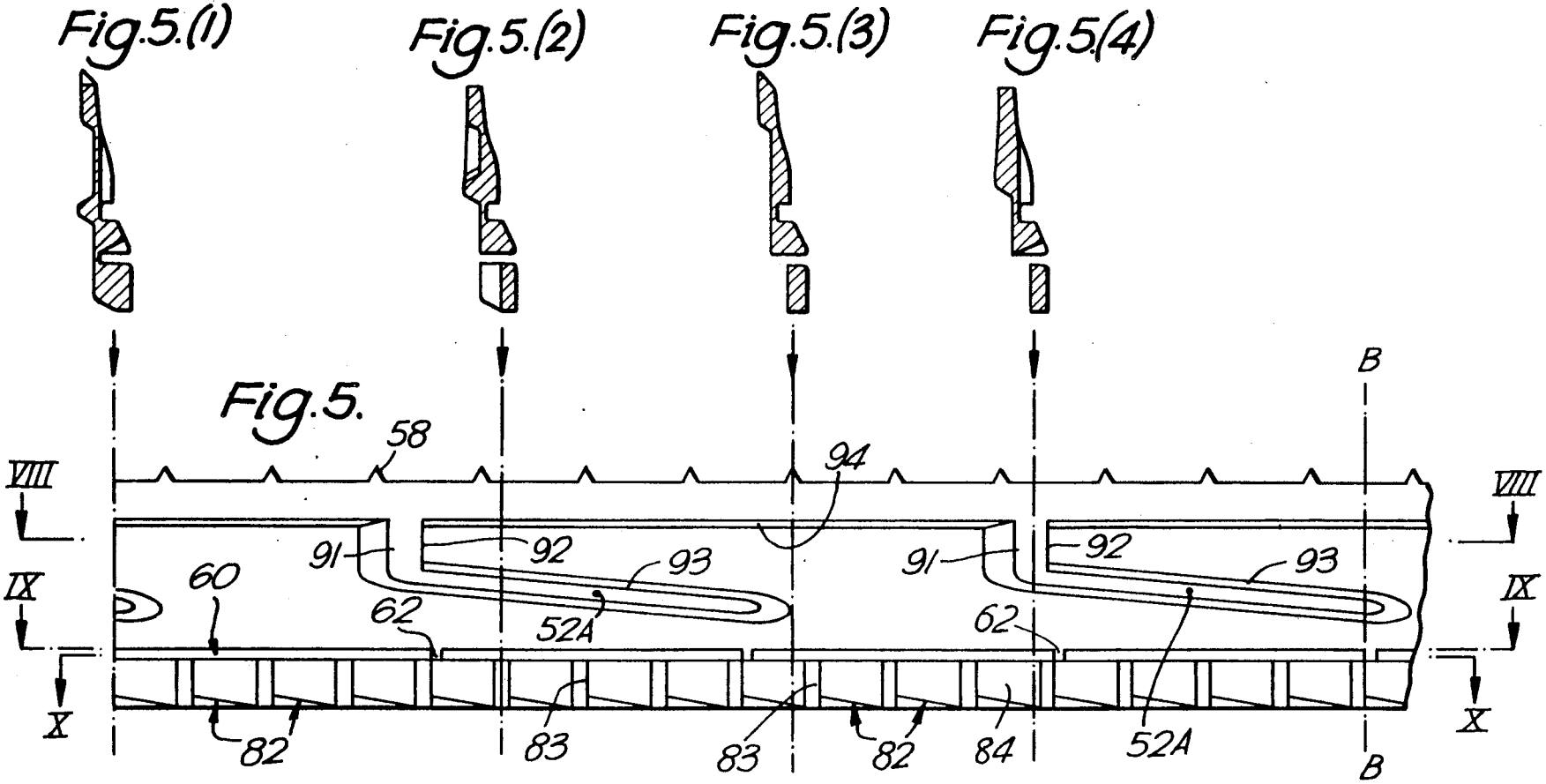
Figure 7A:
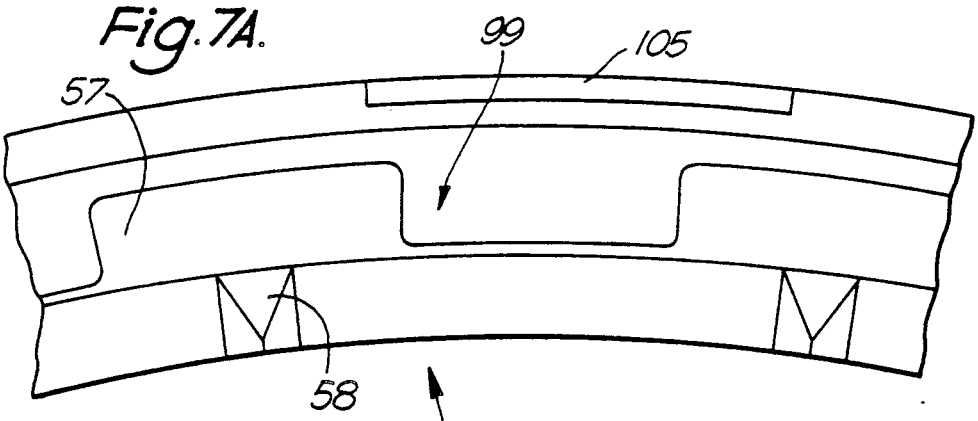
Figure 7:
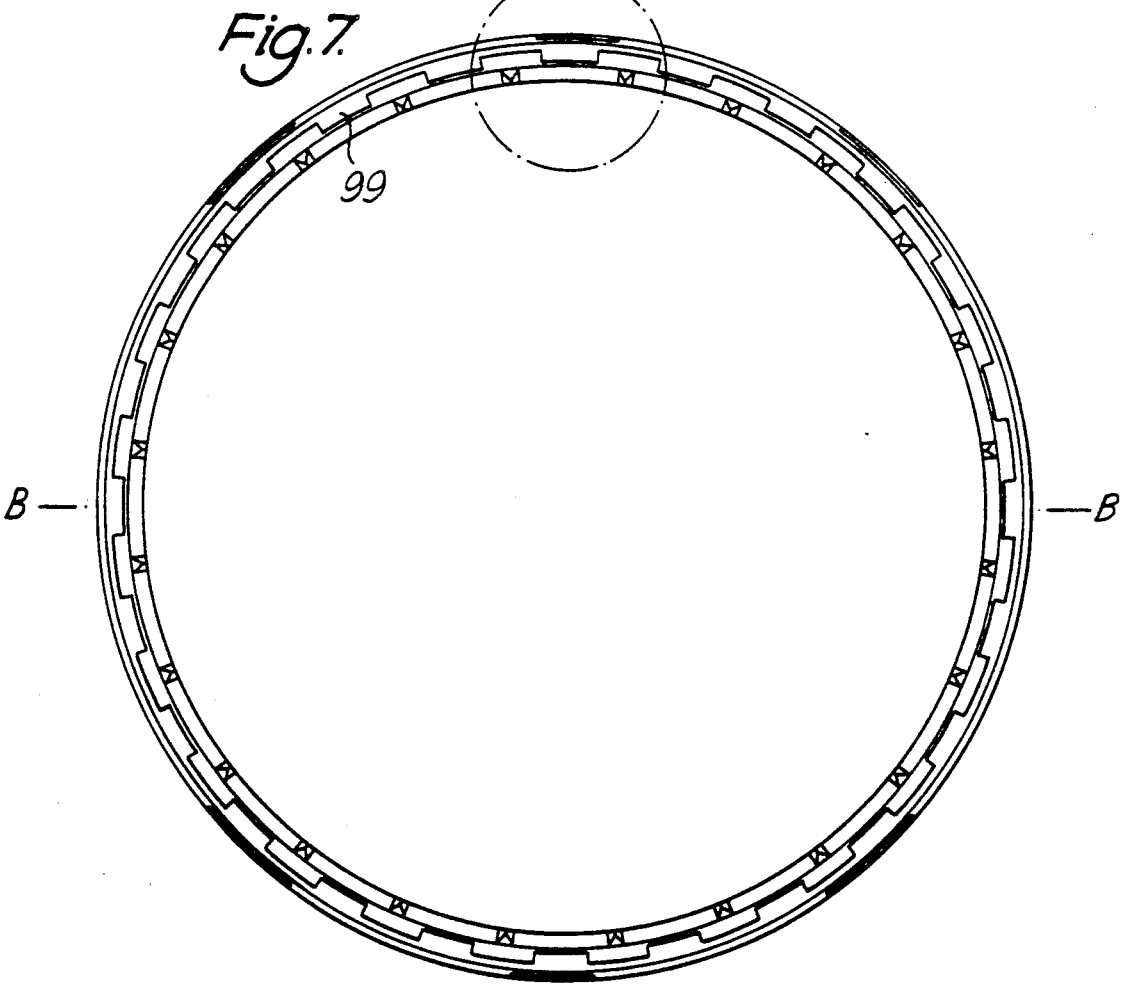
Figure 8:
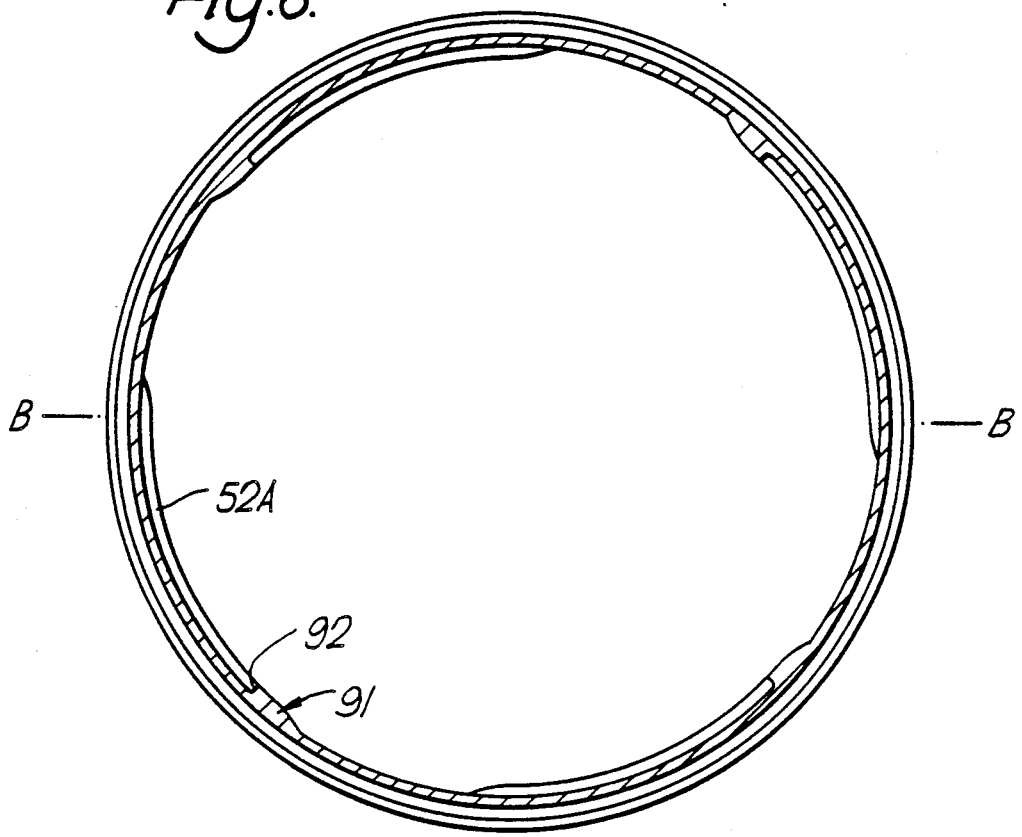
Figure 9:
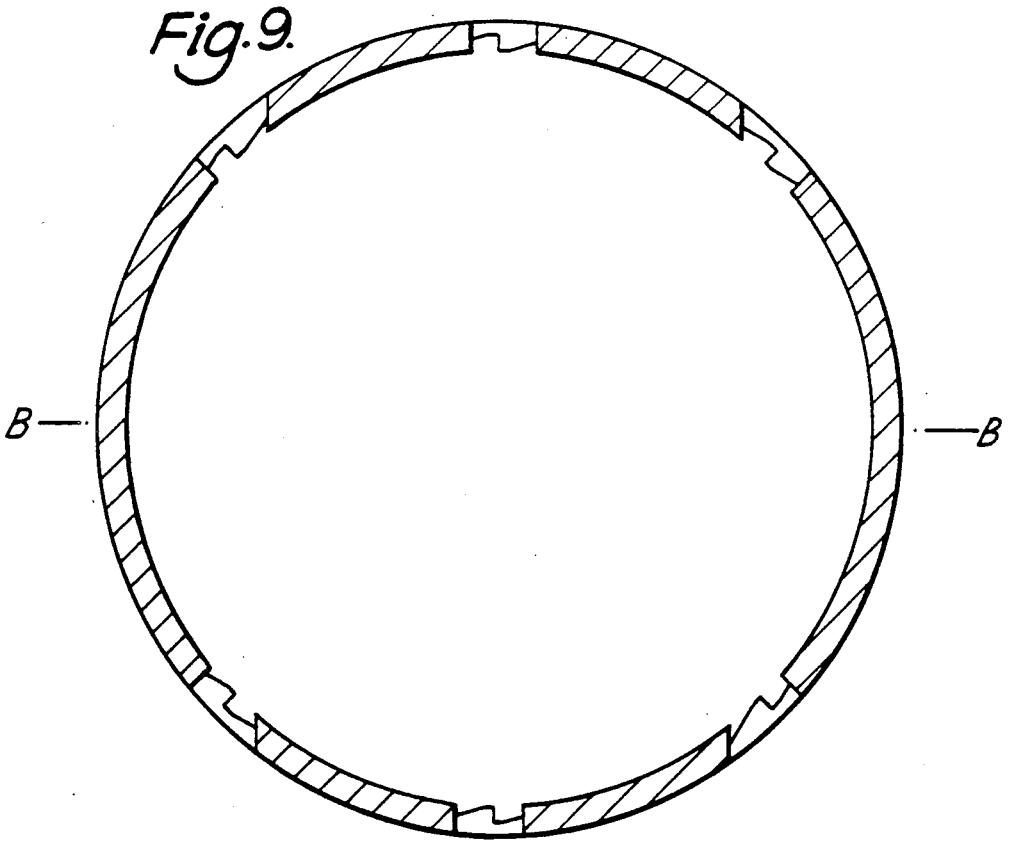
Figure 10:
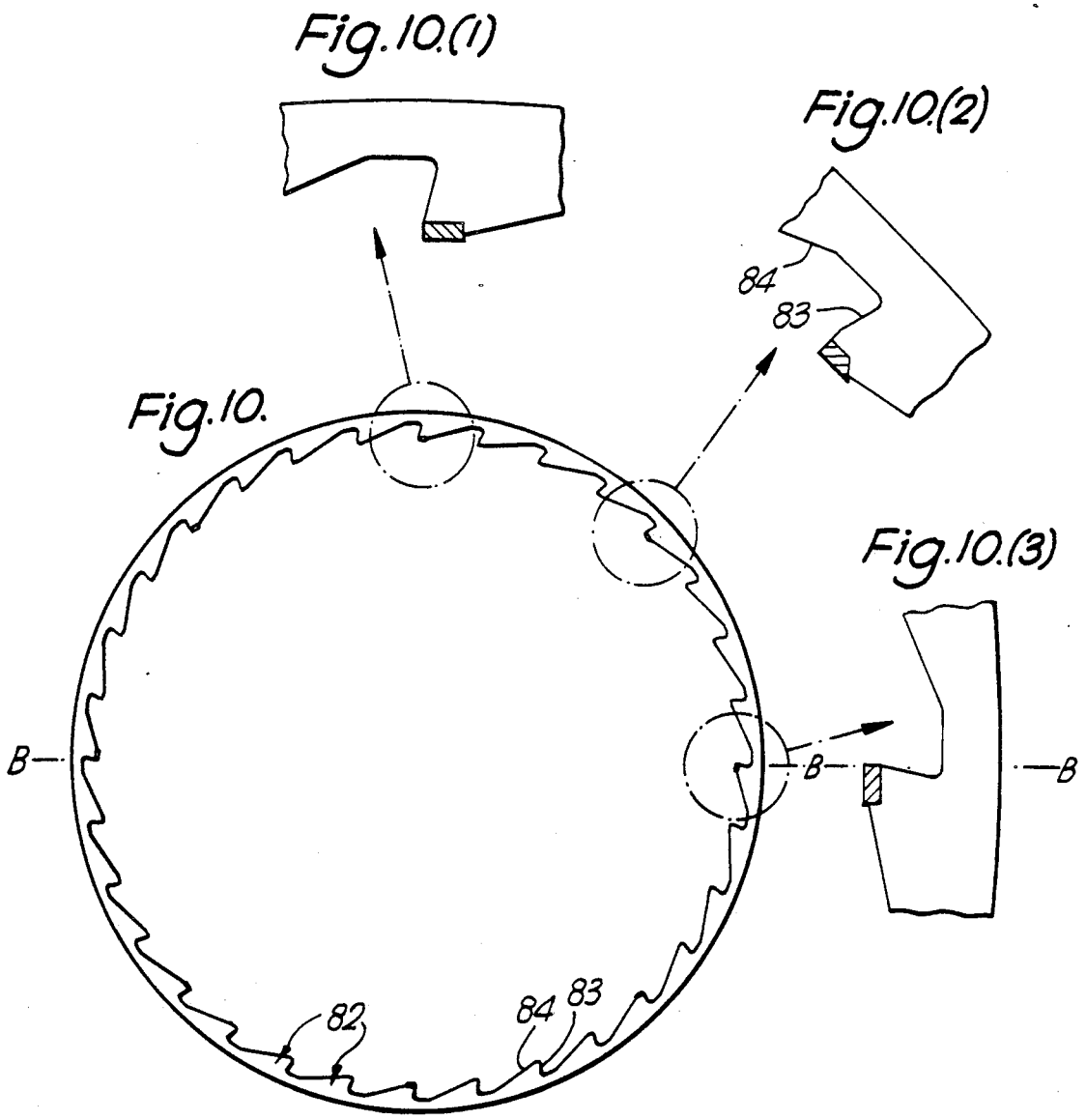
Figure 11:
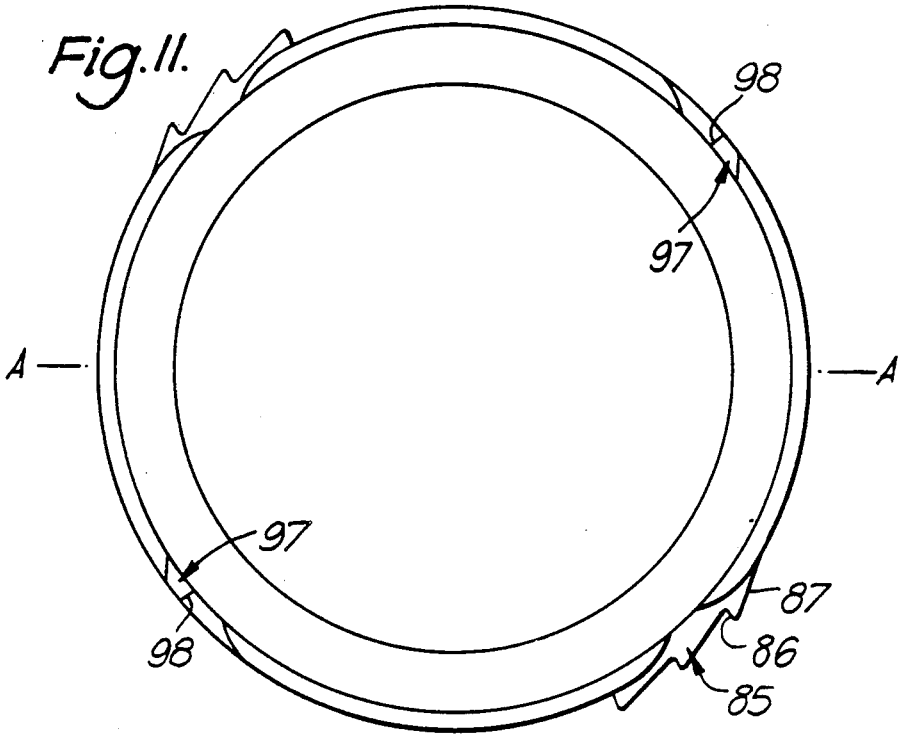
Figure 12:
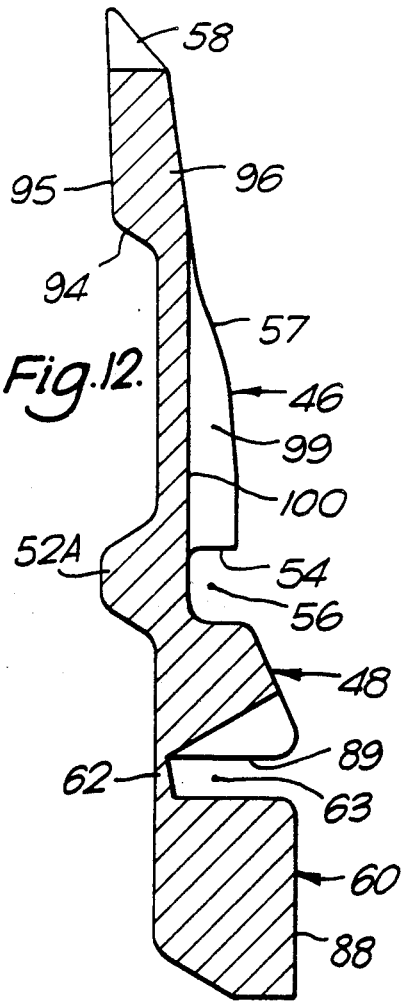
Figure 13:
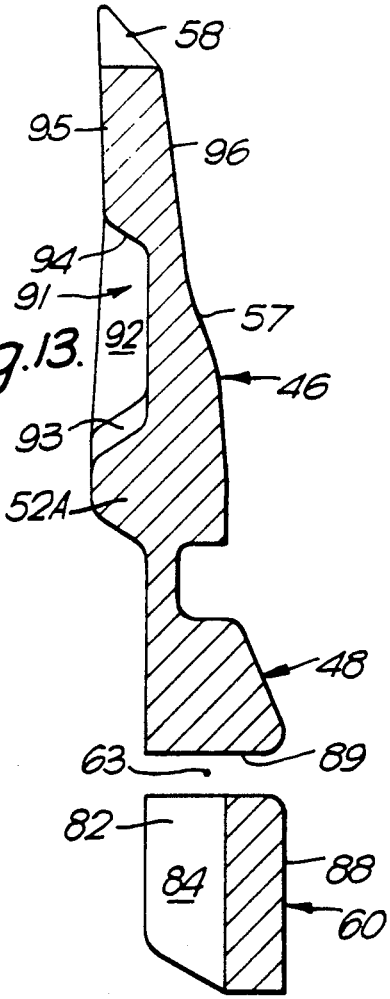
Figure 14:
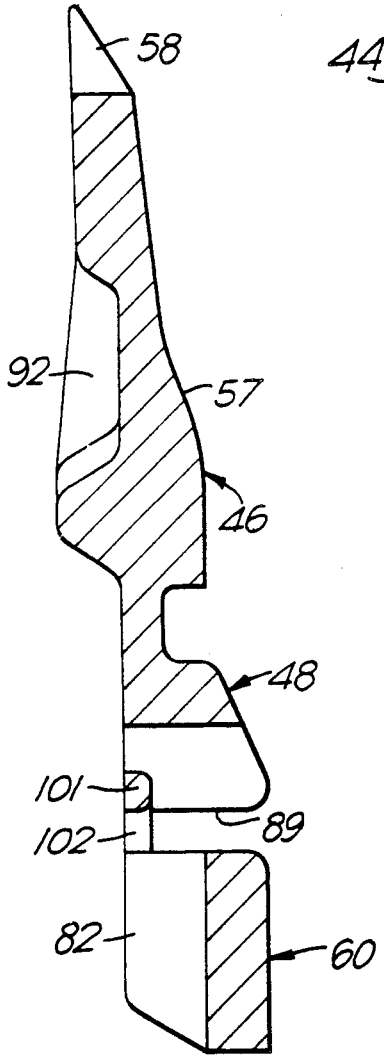
Figure 15:
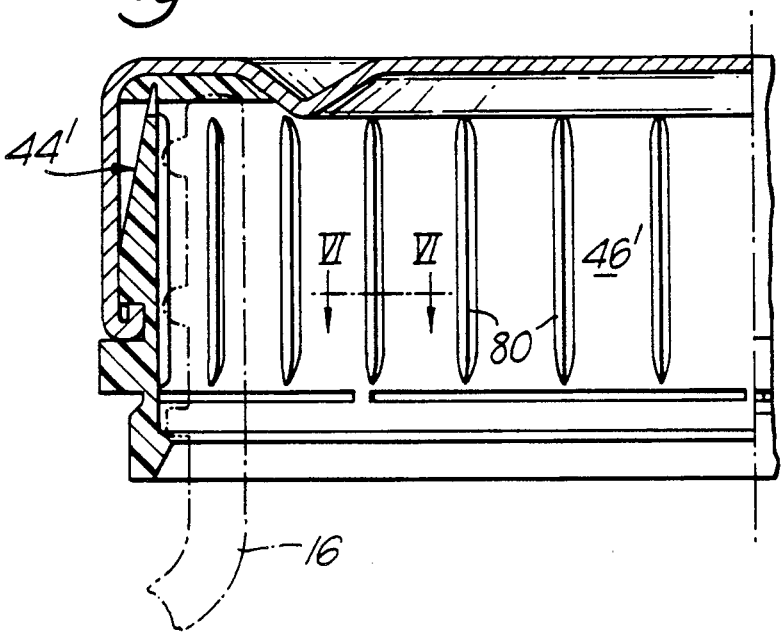
Figure 16:
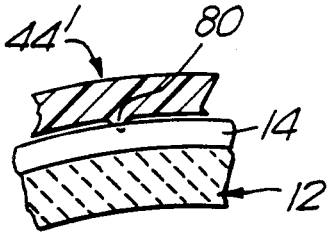

FIG. 3 similarly shows the plastics member of the first closure in side elevation and on one side only of its central axis;

FIG. 4 shows a detail of the first closure when fitted to the container;

FIG. 5 is part of a developed interior view of the plastics member of the second closure, showing two of the parts of the closure screw thread and their associated stops and, in addition a part of the security ring with its ramp formations;

FIGS. 5(1),5(2),5(3) and 5(4) associated with FIG. 5 and are views of the plastics member taken in radial section at various positions around its circumference;

FIG. 6 is a view similar to FIG. 5 of the exterior of the container neck on which the second closure is to be fitted;

FIG. 7 is a plan view of the plastics member of FIG. 5 and 6, as seen from above;

FIG. 7A is an enlarged view of the ringed area of FIG. 7;

FIG. 8 is a plan view of the plastics member as seen on sectional plane VIII—VIII of FIG. 5, showing the parts of the closure screw thread and their associated stops;

FIG. 9 likewise shows the plastics member as seen on sectional plane IX—IX of FIG. 5;

FIG. 10 likewise shows the plastics member as seen on sectional plane X—X of FIG. 5, showing the ramp formations of the security ring and the attachment of the bridges to them;

FIGS. 10(1), 10(2) and 10(3) are enlarged scrap views of the ringed areas of FIG. 10, showing the bridges at three adjacent positions of the security ring;

FIG. 11 is a plan view of the container neck showing the four parts of its thread, the stops on two of those parts, and the two groups of ramp formations;

FIG. 12 is an enlargement of FIG. 5(1);

FIG. 13 is an enlargement of FIG. 5(2);

FIG. 14 is a view similar to FIG. 13 of a variant of the second closure;

FIG. 15 shows the third closure in relation to the container onto which it is fitted, the container being which is shown in ghosted outline; and FIG. 16 is a scrap sectional view on the line VI—VI of FIG. 15 and illustrating the interengagement of the third closure with the screw thread on the container.

Figure 1:
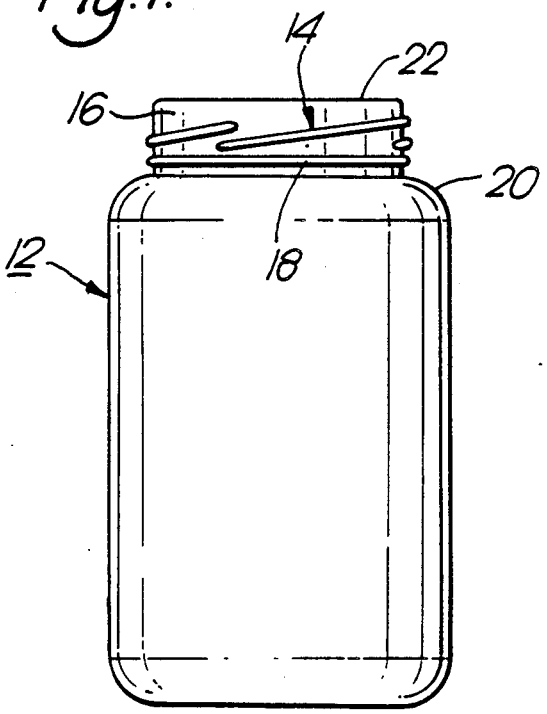
FIG. 1 shows a container to which the closures of FIGS. 2 to 4 and FIGS. 15 and 16 are to be fitted.

Referring now to the drawings, a vacuum closure 10 (FIG. 2) is adapted to close a circular glass jar 12 (FIG. 1) of a jam, pickle, baby food or like food product which is either filled hot or sterlised in the jar after closure. The jar conventionally has a conventional four-start screw thread 14 formed on its neck 16, its four parts being denoted 14A. Also formed on the neck is an outwardly projecting and continuous, peripheral bead 18 which is located below the screw thread and at a spacing above the shoulder 20 of the jar. The top edge or finish 22 of the jar defines the circular mouth of the jar (not visible).

Figure 2:
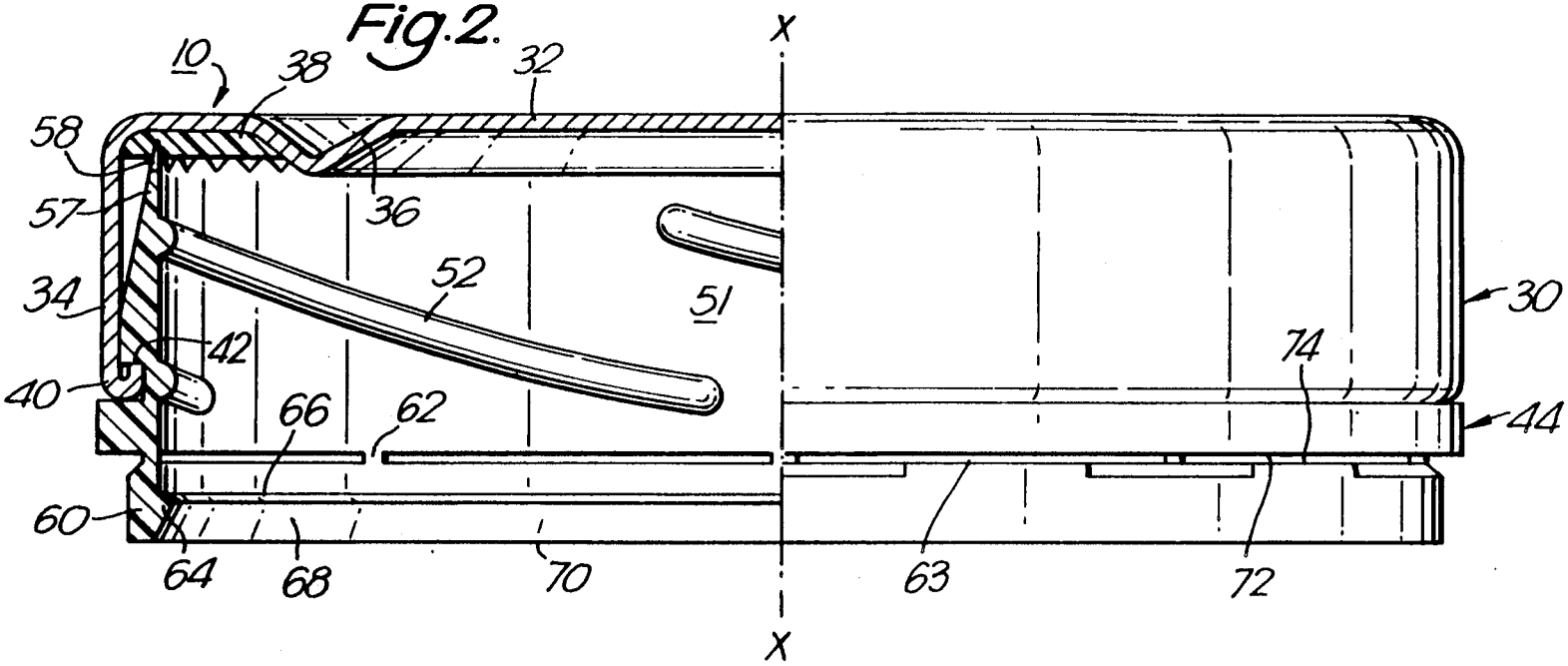
FIG. 2 shows the first closure as seen partly in side elevation and partly in diametral axial section, to a larger scale than FIG. 1.

From FIG. 2 in particular it will be understood that the closure has a substantially conventional metal body shell 30 having a closure panel 32 to overlie the mouth of the jar 12, and a tubular skirt 34 which depends peripherally and integrally from the closure panel. Typically, the shell is formed from 0.15 mm gauge tinplate which is printed and coated as required on its exterior and interior surfaces.

The closure panel 32 is plane except at an annular depression or bead 36. With the skirt 34 this depression forms an inverted channel in which an annular sealing gasket 38 of a suitable plastisol material is formed in situ on the underside of the closure panel by conventional flowing-in and curing operations.

The skirt 34 of the closure is terminated by a continuous inturned curl 40 which presents the cut edge 42 of the closure in a generally upwardly facing direction within the closure interior.

Fitted into the body shell 30 is a moulding 44 of a suitable thermoplastics resin material such as polypropylene or polyethylene. As can be seen from FIGS. 2 and 3 in combination, the moulding is tubular; it can best be considered as being formed of three parts, namely an upper part 46 which is located within the closure interior, an intermediate part 48 having approximately the same external diameter as the skirt 34 and abutting the free edge of the body shell formed by the curl 40, and a lower part 50 which forms a security or tamperevident ring for the closure as will become apparent. The interior surface of the moulding, formed by the parts 46, 48 and 50 in combination, is generally cylindrical; it is denoted by the reference numeral 51 in FIG. 2.

The upper part 46 of the moulding 44 has a four-start thread 52 formed on the interior surface 51. In known manner the four parts 52A of the thread 52 can engage the parts of the jar thread 14 to hold the closure on the jar with the top finish 22 of the jar in hermetic contact with the sealing gasket 38 of the closure to maintain a vacuum above the headspace in the container. On its exterior surface the part 46 of the moulding has a downwardly facing annular shoulder 54 (FIG. 3) which is spaced above the intermediate part 48 by a peripheral groove 56. Above the shoulder the upper part has a gently tapering and generally frustoconical surface 57 which extends to the top edge of the moulding. As shown in FIG. 3, the top edge is serrated, being formed as a series of saw teeth 58. The lower part 50 of the moulding 44 is formed of a continuous ring 60 attached to the intermediate part 48 by a plurality of regularly spaced small bridges 62 spanning a narrow gap 63 between the parts.

A continuous, inwardly projecting bead 64 is formed around the bottom edge of the ring 60 on the inside surface 51 of the moulding. The bead has a generally triangular cross-section, having a substantially horizontal upper surface 66 (FIG. 2) adapted to be snap-engaged under the bead 18 of the jar 12, and a more gently inclined lead-in surface 68 joining the surface 66 to an annular surface 70 which forms the bottom free edge of the moulding.

In the manufacture of the closure the body shell 30 is blanked and formed in conventional manner. The inward curl 40 is likewise conventionally formed as for a lug cap, but the subsequent operation for a lug cap, to form inwardly projecting spaced lugs from the inward curl, is omitted.

After the formation of the inward curl the gasket 38 is formed, after which the moulding 44 can be fitted into the body shell by simple axial movement without orientation, the outer surface 57 of the upper part 46 riding along the inside surface of the curl 40 until the curl snap-engages firmly and permanently into the groove 56 by engagement of the cut edge 42 of the body shell beneath the shoulder 54. The smooth exterior surface presented by the curl assists the movement of the moulding into its snapengaged position.

The intermediate part 48 of the moulding then prevents any further upward movement of the moulding in relation to the body shell by engagement with the undersurface of the curl 40. At this defined position of the moulding its teeth 58 deeply indent the gasket 38 as is shown in FIG. 2.

The axial force required to fit the moulding into the body shell in this way is generated by a suitable ram (not shown) which is engaged against the bottom free edge 70 of the moulding. To reduce the risk of damage to them, the bridges 62 are not required to transmit the force from the lower part 50 of the moulding to the parts 48, 46 above it. Instead, the bridges are arranged to collapse when the force is applied, so that the gap 63 is closed and its opposed upper and lower surfaces 72, 74 come into direct mutual engagement for transmission of the force between them.

The closure is fitted onto the glass jar 12 in usual manner by rotation, for example by a conventional capping machine, so as progressively to engage the threads 14, 52. Rotation of the moulding in relation to the closure at this time is prevented by the indenting engagement of the teeth 58 in the gasket 38 as previously mentioned.

As the capping movement is approaching its completion the bead 64 becomes firmly snap-engaged under the bead 18 of the jar so as subsequently to discourage unauthorised attempts to unscrew the closure. Normal removal of the closure results in rupture of the bridges 62 by the largely axially directed forces imposed upon them by the unscrewing action. The lower part of the moulding is then preferably free to drop down off the bead 18 and onto the shoulder 20, where it is readily visible even to a casual observer.

FIGS. 5 to 13 show a further embodiment of the invention which can be considered as a modification of the embodiment of FIGS. 1 to 4. Wherever appropriate the same reference numerals are therefore used as before to indicate corresponding parts.

As will become apparent from the following description in which they are recited individually, this further embodiment differs from the first embodiment in three significant respects, namely:

(1) the continuous bead 64 of the security ring 60 of the plastics moulding 44 is replaced by a series of circumferentially spaced ramp formations so that the bridges 62 are ruptured primarily by shearing action rather than by traction;

(2) stops are provided on the four parts 52A of the moulding thread 52 for determining accurately the fitted rotational position of the closure; and (3) the generally frustoconical outer face 57 of the upper part 46 of the moulding is interrupted by axial grooves.

Referring now to FIGS. 5 to 13, in particular to FIGS. 5, 9 and 10, in this second embodiment the security ring 60 has thirty-two identical ramp formations 82 spaced regularly around its inner periphery. Each ramp formation has an abutment face 83 which extends substantially radially (and axially) of the closure, and a relatively gently sloping lead-in face 84 which extends from the crest of the abutment face to adjacent the base of the next ramp formation in the forward (i.e. screwing-up) direction of the closure.

As shown in FIGS. 6 and 11, for engagement by the ramp formations 82 of the closure the container neck 16 has six complementary ramp formations 85 arranged in two diametrically opposed groups of three. The parting line of the split mould (not shown) by which the glass jar 12 is formed is denoted by the reference AA, and it will be seen in relation to this split line that the inclination of the abutment and lead-in faces 86, 87 of the ramp formations 85 will allow easy mould separation.

From FIGS. 12 and 13 in particular it will be seen that in this embodiment the outer surface 88 of the security ring 60 is flush (i.e. axially aligned) with the outer periphery of the intermediate part 48 of the plastics moulding 44. Moreover, the apices of the ramp formations 82 lie on the cylindrical envelope of the interior surfaces of the intermediate part and of the upper part 46 of the moulding at the screw thread 52.

Eight regularly spaced and axially extending frangible bridges 62 (FIGS. 5, 9, 10 and 12) by which the security ring 60 is carried from the remainder of the plastics moulding are attached to the security ring at the apices of respective ramp formations 82. From there they extend upwardly (as shown) to attachment to the intermediate part 48 of the moulding at its generally annular lower surface 89. As is clearly shown in FIGS. 10(1), 10(2) and 10(3), the bridges vary in cross-sectional shape in dependance upon their position in relation to the parting line BB of the split tooling by which they are formed, the shape being chosen so that they do not impede, and therefore are not possibly damaged by, tool separation in the radial direction when the moulding is being ejected. In addition, and as illustated in FIGS. 9 and 12, improved access for the mould tooling for the six bridges which do not lie on the parting line BB is provided by locally relieving the lower surface 89 of the intermediate part 48 of the moulding and creating openings 105 through the security ring 60 to its outer surface 88.

The second additional feature recited above for this embodiment is the provision of stops 91 at the trailing ends of the four individual parts 52A of the closure screw thread 52. As can be seen from FIG. 5, each stop presents a radially and axially directed abutment face 92 to the forward direction of the closure between the upper, camming surface 93 of the thread part and a downwardly facing and generally annular shoulder 94 (FIGS. 12, 13) which extends continuously around the interior periphery of the moulding except at the stops. The crests of the thread parts 52A and of the stops 91 are approximately in axial alignment with the substantially cylindrical interior surface 95 of the upper part 46 of the moulding above its shoulder 94. The locally thickened part 96 of the moulding lying above the shoulder 94 carries teeth 58 for preventing rotation of the moulding in the body shell 30 as has previously been described in relation to the first embodiment. The teeth of this embodiment are twenty-four in number and regularly spaced apart rather than being consecutive as before.

FIG. 6 and 11 show that a stop 97 is provided at the trailing end of each of two diametrically opposed parts 14A of its screw thread 14. Each stop 97 has a backwardly presented, axially and radially directed abutment face 98, and by individual abutment with a stop 91 of the plastics moulding the stops 97 accurately define the desired fitted position of the closure on the container neck, so ensuring proper engagement of the ramp formations 82, 85 for the security ring 60 to be detached when the closure is unscrewed.

The third additional feature of this embodiment is apparent from FIGS. 7, 7A and 12. Whereas in the first closure the outer surface 57 of the plastics moulding 44 is continuous around the moulding, in this embodiment the surface is interrupted by identical, axially extending grooves 99 which are disposed around the moulding at a regular spacing. As can be seen particularly from FIG. 12, each such groove extends for the full depth of the annular shoulder 54 defining the top of the peripheral groove 56 into which the curl 40 of the metal body shell is snap-engaged. The base 100 of the axial groove is straight, and extends from the peripheral groove upwardly to its own intersection with the surface 57, leaving a substantially constant remanent thickness of plastics material for the upper part 46 of the moulding up to its interior shoulder 94.

FIGS. 7 and 7A in particular indicate that the axial grooves 99 are of a length to occupy slightly less than one half of the circumferential length of the surface 57. Angularly of the closure they alternate with the teeth 58, so that each tooth is centrally located between a pair of adjacent grooves.

The assembly of the closure of FIGS. 5 to 13 is achieved in the same manner as before, by simple axial movement of the plastics moulding 44 onto the body shell 30 until the curl 40 of the shell becomes resiliently snap-engaged into the peripheral groove 56.

By virtue of its inclination and position, the surface 57 acts as a lead-in surface for the snap-engaging movement. During the movement some distortion of the moulding will necessarily occur. The axial grooves 99 provide localised regions of relative weakness around the moulding. By allowing many small and essentially independant distortions around the periphery of the moulding they discourage gross distortion of the moulding, and reduce the axial forces which are needed to achieve snap-engagement. The use of reduced axial forces for assembly of the closure in turn reduces the risk of breakage or damage to the bridges 62 during the assembly operation.

In relation to the preceding paragraph it should be noted that, because the body shell 30 is substantially of steel (rather than aluminium) and moreover has the curl 40 formed around its free edge, it has a substantial rigidity and so undergoes substantially no distortion when the plastics moulding is being inserted into it. However, the increased flexibility provided for the moulding by the axial grooves 99 enables a substantial degree of penetration of the curl within the peripheral groove 56 to be achieved, so ensuring secure retention of the plastics moulding by the body shell at all times, in particular during capping and after the closure has been subjected to thermal pasteurisation or sterilisation processes. The depth of the groove is such as to ensure that little or no inward pressure is exerted by the curl on the base 100 of the groove.

For use the closure is screwed onto the jar neck 16 by a capping machine which may be conventional and is therefore not shown or described. As previously mentioned, the stops 91, 97 cooperate to determine the fitted position of the closure, and so ensure that ramp formations 82, 85 of the security ring 60 and the container neck are properly engaged. The use of circumferentially disposed ramp formations rather than the circumferentially extending beads 64,18 of the first embodiment is believed by Applicants to reduce the shear forces which are exerted on the bridges 62 during capping and is therefore generally preferred. If desired, in this and the other described embodiments of the invention the bridges may be protected against excessive shear forces during capping by means of opposed castellations which are formed on the security ring and the intermediate part 48 of the plastics moulding. The castellations are interdigitated across the gap 63 spanned by the bridges, so that abutment of their side faces can define an upper limit for the shearing movement to which the bridges may be subjected.

In the variation of the second closure which is illustrated in FIG. 14, the security ring 60 is attached permanently to the intermediate part 48 of the plastics moulding by a flexible strap 101. The strap extends circumferentially of the moulding between two adjacent bridges 62. It lies along the line of the apices of the ramp formations 82 between those bridges, and is accommodated by the intermediate part 48, the lower surface 89 of which is locally relieved for that purpose. At its two ends it is integrally attached by axially extending posts to the security ring and the intermediate part 48 respectively, only the post 102 for the security ring being shown. After the closure has been unscrewed and the bridges 62 broken, it holds the security ring captive on the closure.

FIGS. 15 and 16 show a third embodiment of the invention which differs from the embodiment of FIGS. 1 to 4 only in the screw-threaded engagement of the closure on the container. In this embodiment the plastics moulding, now referenced 44', has no screw thread formation such as the thread 52. Instead, it is moulded to have a series of regularly spaced and parallel, cusp-like ridges 80, which extend axially down the upper part 46' of the moulding. These ridges are arranged to make an interference fit with the screw thread 14 of the glass jar.

The closure of FIGS. 15 and 16 is fitted onto the jar 12 by simple axial motion (and without orientation), the ridges 80 riding down the thread 14 during this time. The pressure created by the interference at the intersections of the ridges and the thread thereafter causes deformation of the ridges in correspondence with the thread, rather in the manner of the thread formation created in the plastisol liner of a PT cap.

With suitable choice of material for the moulding 44', and particularly if the closure is subjected to heat, for example, by a thermal sterilisation process, this deformation can be of a sufficiently permanent nature for subsequent normal use of the closure to open or reclose the jar by rotation in the appropriate direction.

Rather than being open-ended as particularly described, the plastics member of a closure in accordance with the invention may be partially or wholly closed adjacent the closure panel of the body shell; a suitable formation or gasket may then be provided within the plastics member for sealing engagement with the container, for some applications the plastics member itself may be arranged to provide the seal.

Whilst it has particular application to screw closures having security rings for indicating unauthorised removal, the invention may also be applied to screw closures lacking such rings. Three closures having such an arrangement are as the closures which are shown and described above with reference to FIGS. 2 to 16 of the drawings, but lacking the security rings 60 of those closures. Also, arrangements for preventing relative rotation of the moulding in the body shell may be used other than by engagement of the plastics member with sealing compound on the closure panel of the body shell, as is particularly shown and described.

I claim:

1. A screw closure, which has a metal body shell with a closure panel and a tubular skirt depending integrally therefrom, and a preformed tubular member of a moulded plastics material providing within the skirt of the metal body shell a generally cylindrical thread-forming region for engagement with a thread formation of the container, the plastics member being fitted into the skirt of the body shell after moulding by relative axial movement and snap-engagement of an end portion of the body shell behind an annular shoulder of the plastics member, the annular shoulder being interrupted by a plurality of circumferentially spaced, axially extending grooves which are formed in the plastics member exterior and extend from the annular shoulder towards the closure panel.

2. A screw closure in accordance with claim 1, wherein the thread-forming region of the plastics member is formed with a thread formation by the moulding process.

3. A screw closure in accordance with claim 2, of which the thread formation has at least one stop arranged for cooperation with a complementary stop provided on the container for determining the fitted position of the closure.

4. A screw closure in accordance with claim 1, wherein the thread-forming region is adapted to conform to the thread formation on the container after the closure has been applied.

5. A screw closure in accordance with claim 1, wherein the plastics member is extended beyond the free edge of the body shell as a security ring which is adapted, by engagement with the container, to provide evidence that the closure has been unscrewed from the container.

6. A screw closure in accordance with claim 5, wherein the security ring is attached by frangible bridges at which it may become detached from the remainder of the plastics member by axial and/or circumferential forces generated when the closure is unscrewed.

7. A screw closure in accordance with claim 5, wherein the security ring has a plurality of circumferentially disposed ramp formations having generally radially directed abutment faces, the ramp formations being arranged for their abutment faces to engage the abutment face of a complementary ramp formation of the container to prevent rotation of the security ring in relation to the container when the closure is unscrewed from its fitted position.

8. A screw closure in accordance with claim 5, wherein the security ring has an annular shoulder for snap-engagement beneath a complementary formation of the container as the container is being rotated to its fitted position.

9. A screw closure in accordance with claim 1, wherein the end portion of the body shell is formed as an inturned curl by which the free edge of the body shell is presented for engagement with the annular shoulder of the plastics member.

10. A screw closure in accordance with claim 1, wherein the annular shoulder forms part of a peripheral groove of the plastics member.

11. A screw closure in accordance with claim 9, wherein the body shell including the inturned curl thereof is substantially of steel.

12. A screw closure in accordance with claim 1, wherein the plastics member is open-ended and engages a sealing gasket which is provided on the closure panel for sealing engagement with a said container so as to prevent relative rotation of the body shell and the plastics member when the closure is being fitted to or removed from the container.

13. A screw closure in accordance with claim 12, wherein the plastics member has a serrated free edge at which it engages the sealing gasket.

14. A screw closure in accordance with claim 12, wherein the sealing gasket is formed in situ from a plastisol compound.

* * * * *